US010018025B2

(12) United States Patent
Ciezobka et al.

(10) Patent No.: US 10,018,025 B2
(45) **Date of Patent: *Jul. 10, 2018**

(54) HYDRAULIC FRACTURING SYSTEM AND METHOD

(71) Applicant: GAS TECHNOLOGY INSTITUTE, Des Plaines, IL (US)

(72) Inventors: Jordan Ciezobka, Addison, IL (US); Iraj Salehi, Naperville, IL (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/445,044

(22) Filed: Feb. 28, 2017

(65) Prior Publication Data

US 2017/0298719 A1 Oct. 19, 2017

Related U.S. Application Data

(63) Continuation of application No. 14/469,065, filed on Aug. 26, 2014, now Pat. No. 9,581,004.

(51) Int. Cl.
*E21B 43/26* (2006.01)

(52) U.S. Cl.
CPC ..... *E21B 43/26* (2013.01)

(58) Field of Classification Search
CPC ..... E21B 43/26; E21B 43/003; E21B 28/00; E21B 43/263; E21B 43/267; E21B 47/18; E21B 47/187
See application file for complete search history.

(56) References Cited

U.S. PATENT DOCUMENTS

| | | | |
|---|---|---|---|
| 2,915,122 | A | 12/1958 | Hulse |
| 3,048,226 | A | 8/1962 | Smith |
| 3,602,311 | A | 8/1971 | Whitsitt |
| 3,933,205 | A | 1/1976 | Kiel |
| 3,965,982 | A | 6/1976 | Medlin |
| 5,536,115 | A | 7/1996 | Keck |
| 9,581,004 | B2 | 2/2017 | Ciezobka et al. |
| 2012/0199356 | A1 | 8/2012 | Nichols |
| 2014/0014338 | A1 | 1/2014 | Crews et al. |
| 2014/0251623 | A1 | 9/2014 | Lestz et al. |
| 2015/0192117 | A1 | 7/2015 | Bridges |

OTHER PUBLICATIONS

Ciezobka, J., "Marcellus Gas Shale Project," RPSEA Industry Workshop: Summary of Results for Completed GTI Marcellus Shale R&D Project, Canonsburg, PA, May 7, 2013 (27 pages).
Co-pending U.S. Appl. No. 15/464,939, Ciezobka et al., "Hydraulic Fracturing System and Method," filed Mar. 21, 2017.
Co-pending U.S. Appl. No. 15/600,155, Ciezobka et al., "Hydraulic Fracturing System and Method," filed May 19, 2017.

*Primary Examiner* — Zakiya W Bates
(74) *Attorney, Agent, or Firm* — Pauley Erickson & Kottis

(57) ABSTRACT

A hydraulic fracturing system and method for enhancing effective permeability of earth formations to increase hydrocarbon production, enhance operation efficiency by reducing fluid entry friction due to tortuosity and perforation, and to open perforations that are either unopened or not effective using traditional techniques, by varying a pump rate and/or a flow rate to a wellbore.

14 Claims, 7 Drawing Sheets

HYDRAULIC FRACTURING SYSTEM AND METHOD

CROSS REFERENCE TO RELATED APPLICATION

This application is a continuation application of U.S. patent application Ser. No. 14/469,065, filed on 26 Aug. 2014. The co-pending parent patent application is hereby incorporated by reference herein and is made a part hereof, including but not limited to those portions which specifically appear hereinafter.

STATEMENT REGARDING FEDERALLY SPONSORED RESEARCH OR DEVELOPMENT

This invention was made with government support under Contract No. DE-AC26-07NT42677 awarded by the U.S. Department of Energy. The government has certain rights in the invention.

BACKGROUND OF THE INVENTION

Field of the Invention

This invention is directed to a hydraulic fracturing system and method for enhancing an effective permeability of low permeability earth formations to increase hydrocarbon production, enhance operation efficiency by reducing fluid entry friction due to tortuosity and perforation, and to open perforations that are either unopened or not effective using traditional perforating techniques including techniques utilizing shaped explosive charges, as well as reducing entry friction in slotted pipe during multi stage hydraulic fracturing operations.

Discussion of Related Art

Hydraulic fracturing is a method of extracting hydrocarbons from earth formations in which thousands of gallons of a fracturing fluid, generally water, pro pants, and other chemicals, are injected into a wellbore and a surrounding earth formation. The high pressure creates fractures in the earth formation, along which hydrocarbons, such as gas and petroleum, may flow to the wellbore and collected therefrom. However, this basic hydraulic fracturing method is unable to extract a maximum amount of hydrocarbons. Generally, after an initial fracturing operation, pumping continues to cause deepening and widening of the fissures by injection of more fluid. While it is generally desirable to open a plurality of fractures in a selected stratum, the basic process is only capable of creating a few fractures at most. When an incipient fracture begins to open, the fracturing fluid enters this new space and the pressure in the wellbore and fractures decreases reducing the tendency to open new fractures. This phenomenon limits the results of the basic fracturing process.

Other known hydraulic fracturing processes attempt to improve the process described above by adding a hammer effect to transmit a relatively large hydraulic shock against the formation to be fractured. For example, U.S. Pat. No. 2,915,122 to Donald S. Hulse and U.S. Pat. No. 3,048,226 to E. W. Smith. Other known hydraulic fracturing processes use a series of pressure pulses to improve the typical fracturing process. For example, U.S. Pat. No. 3,602,311 to Norman F. Whitsitt and U.S. Pat. No. 3,933,205 to Othar Meade Kiel. However, these known processes generally effect only a small number fractures radiating from the wellbore and may cause damage to piping and equipment.

Other known hydraulic fracturing techniques attempt to overcome the issue of reduced pressure due to newly opened fractures by blocking the newly formed fractures to allow a return to the initial pressure to allow additional fractures to be created. These methods include using degradable and/or non-degradable ball sealers that enter newly opened perforations to restrict flow of fracturing fluid into the opened perforations, thus forcing the fracturing fluid to open new perforations and to create new fractures. Ball sealers land on the newly opened perforations until a complete ball-out is achieved, where all possible perforations are opened and then sealed with a ball. At this point, no more flow is possible and the ball sealers have to be removed by flowing the well back, or in the case of using degradable balls, a long period is needed to allow for the balls to dissolve. These techniques are not practical in long horizontal wells where 100 or more perforation clusters are used to stimulate the long horizontal well. Furthermore, the wait time for the degradable ball sealers to dissolve would render the operations uneconomical.

As such, there is a need (fear an improved hydraulic fracturing process that provides an increased hydrocarbon production without the shortcomings of the known processes.

SUMMARY OF THE INVENTION

It is one object of this invention to provide a system and method for providing a pressure pulse to a wellbore to improve fracturing of an earth formation to provide increased hydrocarbon production.

It is another object of this invention to provide the pressure puke and minimizes or eliminates wear or damage to a fracturing pump and/or other fracturing equipment.

These and other benefits can be provided by an embodiment of this invention which includes one or more of a fracturing fluid storage tank, a pre-blender, a slurry-blender, a proppant storage and delivery system, a manifold, a high-pressure fracturing pump, a chemical truck, a flow line connected to a wellhead of a wellbore, a bleed-off valve and a bleed-off line connected to a pit. Alternative embodiments of this invention may be created without one or more of the listed components and may include additional components.

In a preferred embodiment, the fracturing tank supplies a primary component of a fracturing fluid and/or a fracturing slurry, each of which preferably comprise water. However, other fluids, gels and other materials may be used as the primary component of the fracturing fluids and/or fracturing slurry. The fracturing tank is connected to the pre-blender, for example, a mixing truck that also connects with a chemical truck, and mixes the water, polymer and other chemicals to make the fracturing fluid (without a proppant). The pre-blender connects to the manifold and/or the slurry-blender to provide either the fracturing fluid or the fracturing slurry to the high-pressure fracturing pumps. The slurry-blender is connected to the proppant storage and delivery system to create the fracturing slurry by mixing the fracturing fluid with the proppant. The slurry-blender connects to the manifold. The manifold receives the fracturing fluid, with or without proppant, at a low pressure from the pre-blender or the slurry-blender and distributes the fluid and/or slurry to the high-pressure fracturing pumps. The manifold then receives the fluids at a high pressure from the high-pressure fracturing pumps and directs the fluid to a ground iron leading to the wellhead and the wellbore.

The high-pressure fracturing pump pumps the fracturing fluid, with or without proppant, to the wellhead at a pump rate through a flow line. In a preferred embodiment, the flow line comprises a plurality of pipes which connect the high-pressure fracturing pumps, through a single or multiple common manifolds, to a wellhead of the wellbore. In an embodiment of this invention, the plurality of flow lines comprise at least one constant-flow flow line and at least one variable-flow flow line which includes the bleed-off valve and the bleed-off line. The constant-flow line supplies a first percentage of a flow rate supplied by the high-pressure fracturing pump to the wellhead. The flow rate of the constant-flow line preferably does not vary significantly. The variable-flow line supplies a second percentage of the flow rate supplied by the high-pressure fracturing pump to the wellhead. In a preferred embodiment, the flow rate of the variable-flow line can be varied by diverting a portion of the fracturing fluid via the bleed-off valve to a pit, tank, another wellhead and wellbore, or to any other holding device. In an alternative embodiment, the flow line may comprise a single pipe connected to the wellhead with a bleed-off line and without the constant-flow line.

In operation, a method of hydraulic fracturing stimulation according to one embodiment of this invention includes pumping the fracturing fluid, with or without the proppant, at a pump rate and injecting the fracturing fluid under pressure into the wellhead at an initial flow rate and creating small fractures in deep rock formations. As the system moves towards an equilibrium pressure with few or no new fractures being created and/or a fracture network complexity is no longer increasing, the method of this invention includes introducing a pressure pulse into the wellbore for a pulse period of tune causing a temporary increase of pressure leading to opening new fractures. The pressure pulse comprises changing the initial flow rate to a primary or pulse flow rate and then to a secondary flow rate. In embodiments of this invention, the primary or pulse flow rate is less than the initial flow rate, ranging from 10% lower to nearly 100% lower, and the secondary flow rate is equal to the initial flow rate. In preferred embodiments, the primary or pulse flow rate may range from 25% to 75% lower that the initial flow rate. More preferably, the primary or pulse flow rate is 50% lower than the initial flow rate. In another embodiment of this invention, the primary or pulse flow rate is ideally dropped to zero, however a zero flow rate may not be practical because of limitations on the equipment and/or because a zero flow rate will cause proppant transport issues and may damage equipment. In alternative embodiments, the primary or pulse flow rate may be greater than the initial flow rate and/or the secondary flow rate may not equal the initial flow rate and may instead be greater than or less than the initial flow rate. In an embodiment of this invention, the pulse period of time is less than one minute, in a preferred embodiment of this invention, the pulse period of time is less than 10 seconds.

In an embodiment of the method of this invention, the pressure pulse is introduced by diverting a portion of the fracturing fluid away from the wellbore to provide a reduced flow rate to the wellbore for the pulse period of time. In this embodiment, the pump rate of the high-pressure fracturing pump remains constant so as to avoid placing additional stress on the high-pressure fracturing pump. In a preferred embodiment, the step of introducing the pressurized pulse comprises a plurality of pressurized pulses.

In an alternative embodiment, the pressure pulse is introduced by changing the pump rate of a fracturing pump from the pump rate to the pulse pump rate and back to the pump rate. Preferably, the pulse pump rate is less than the pump rate. Alternatively, the pulse pump rate is greater than the pump rate.

In another alternative embodiment, the pressure pulse includes increasing the initial flow rate to a pre-pulse or intermediate flow rate, rapidly dropping the flow rate to a primary or pulse flow rate and returning the flow rate to the pre-pulse or intermediate flow rate and repeating this cycle for a number of times before returning the flow rate to the initial flow rate. This approach may be done by increasing and decreasing the pump rate and/or by redirecting the flow of fracturing fluid to change the flow rate.

The invention provides an improved hydraulic fracturing process that provides increased hydrocarbon production without the shortcomings of known processes.

BRIEF DESCRIPTION OF THE DRAWINGS

These and other objects and features of this invention will be better understood from the following detailed description taken in conjunction with the drawings, wherein.

DESCRIPTION OF PREFERRED EMBODIMENTS

Figure 1:
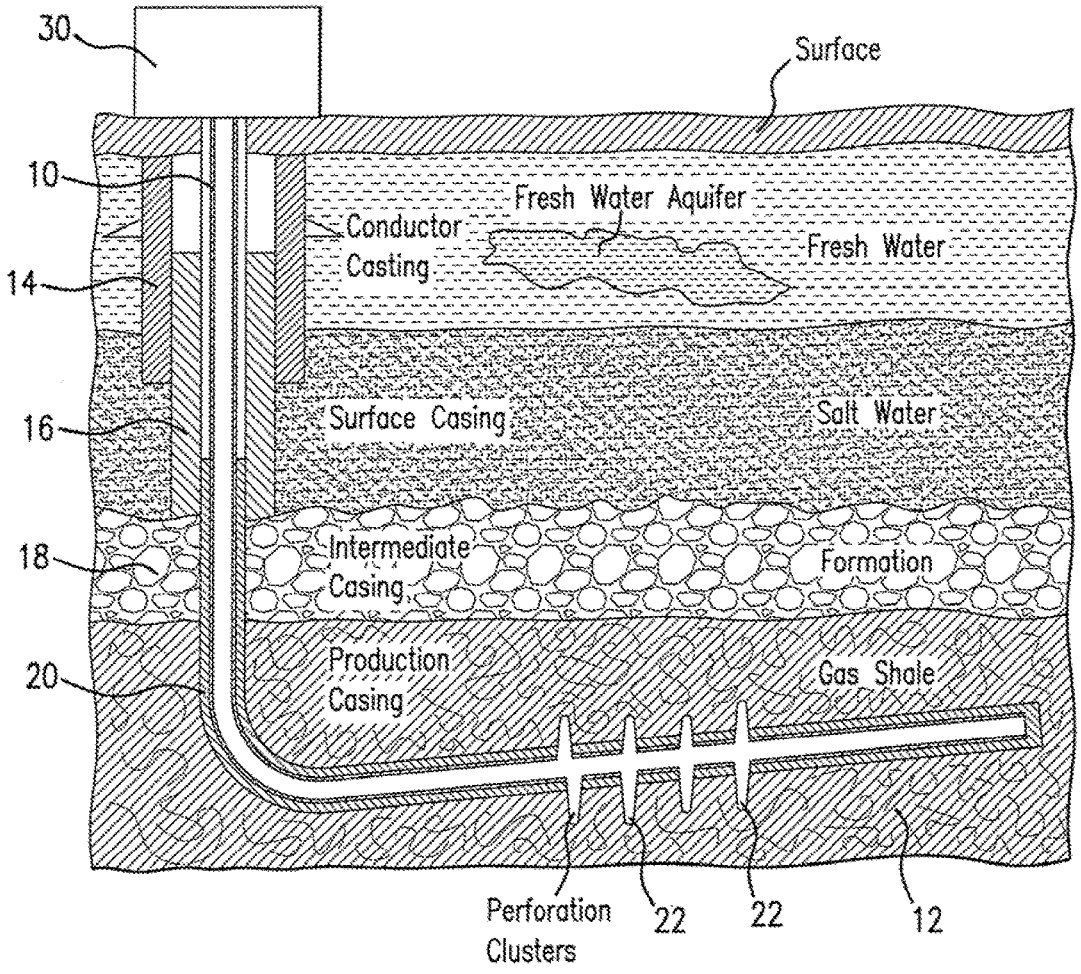
FIG. 1 is a schematic diagram of a wellbore.

Hydraulic fracturing stimulation is a method of enhancing an effective permeability of a low permeability formation by extending a wellbore in the formation and creating propped fractures that enable hydrocarbon production from vast amounts of reservoir and channeling, the hydrocarbons back to the wellbore from which the hydraulic fractures emanate. FIG. 1 shows a schematic view of a horizontal wellbore 10 for a fracturing operation. In this representation, the wellbore 10 extends vertically downward into the earth until reaching a target reservoir 12 (e.g. gas shale) where the wellbore 10 extends generally horizontal at a slight upward angle. It should be noted that the wellbore 10 is representative and the system and method of this invention be used with any type of wellbore that is necessary to access an earth formation. Furthermore, the method of this invention will be described in connection with gas shale however, it should be understood that the method may also be used with tight gas, tight oil, coal seam gas and other earth formations requiring hydraulic fracture stimulation including but not limited to geothermal reservoirs.

In the embodiment of FIG. 1, the wellbore 10 includes a conductor casing 14, a surface casing 16, an intermediate casing 18 and a production casing 20. However, it should be understood that the method of this invention is not limited to the wellbore 10 of FIG. 1 and may be used with other types of wellbore configurations, including fracture stimulation of vertical or slant wellbores. FIG. 1 shows the well bore extending into the earth including a surface layer, a salt water layer, a formation layer, and the gas shale layer. However, it should be understood that the system of this invention is not limited to this geologic formation and may be used with other geologic formations. It should also be understood, that the system and method of this invention may be used with a subterranean extraction process including, but not limited to, enhanced geothermal systems.

In a preferred embodiment of this invention, the wellbore 10 further includes a plurality of perforation clusters 22. The industry standard is to perforate multiple sections of the horizontal or vertical wellbore usually in 3 or 4 short sections called perforation clusters, spaced a short distance apart. For example, if a 200 foot section of the reservoir is to be fracture stimulated, an approach would be to perforate four, 1 foot sections of the wellbore spaced 50 feet apart, resulting in 4 clusters of perforations that should create 4 or more individual fractures. However, any number of perforation clusters and/or spacing may be used. For example, long horizontal wells may include 120 or more perforation clusters.

A typical fracture treatment is designed to be pumped at a constant flow rate to a wellhead and a wellbore, where increasing pressure in the wellbore fractures the earth formation. The method of this invention involves changing the fracturing flow rate rapidly to impart a pressure pulse that can open unopened perforations by exceeding a perforation breakdown pressure.

In an embodiment of this invention, the pressure pulse is imparted by rapidly shutting off a fracturing pump 42 (FIG. 4) and turning the fracturing pump 42 back on. Alternatively, the pressure pulse may be imparted by changing by rapidly increasing or decreasing a pressure of a pump rate of the fracturing pump 42. These methods are preferably conducted with fracturing fluid which does not include proppant, however; the methods may also be conducted with the fracturing fluid with proppant, also known as a fracturing slurry.

Figure 2:
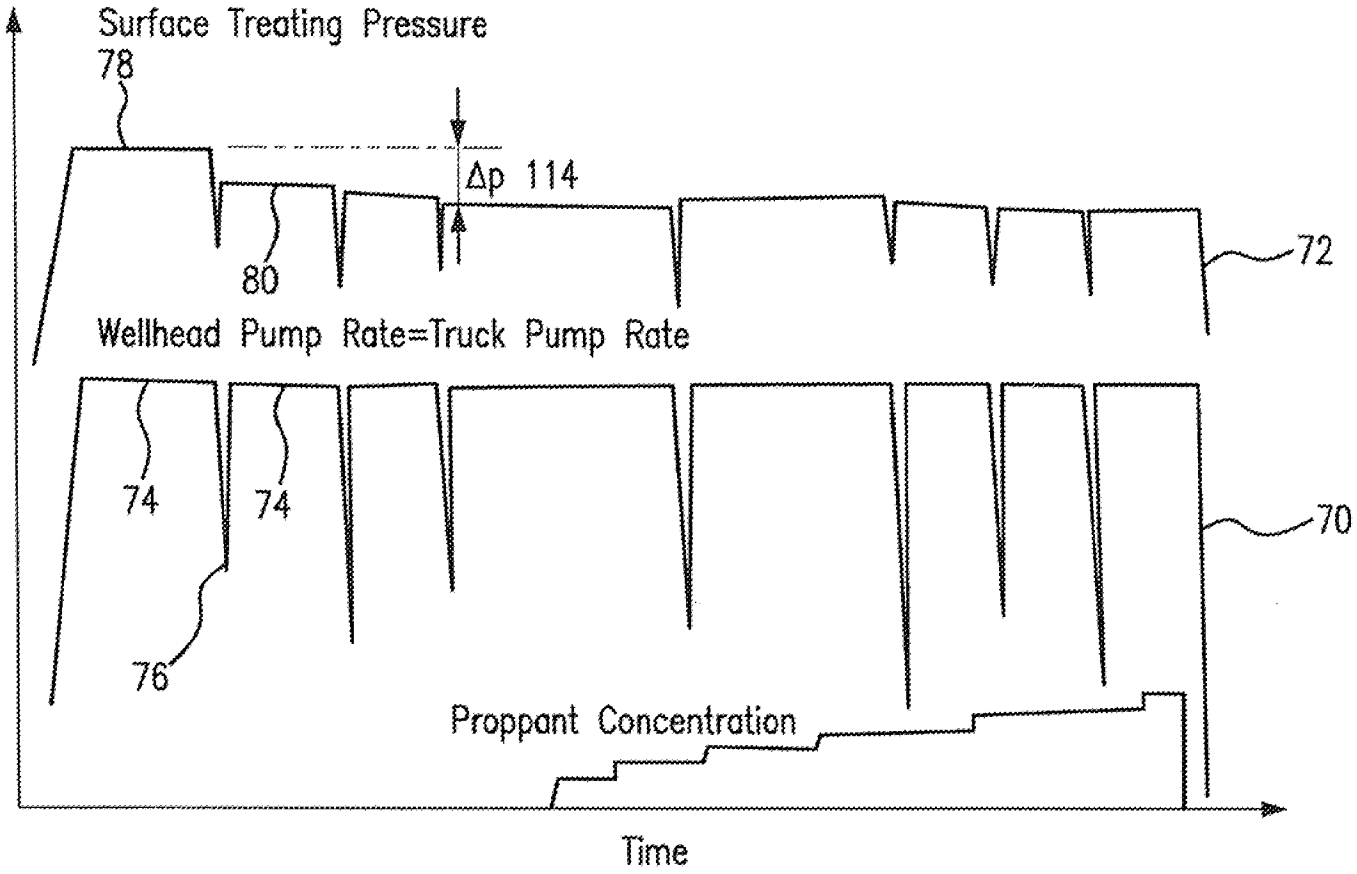
FIG. 2 is a graph showing a pump rate and a surface treating pressure of a method of hydraulic fracturing according to an embodiment of this invention.

FIG. 2 shows a graph showing an embodiment of this invention where a pump rate 70 is varied to impart a pressure pulse to the wellhead to cause a change (ΔP) in a surface treating pressure 72. In this embodiment, the pump rate 70 starts at an initial pump rate 74 and rapidly dropped to primary or pulse pump rate 76 before returning to the initial pump rate 74, this cycle is preferably repeated a plurality of times. As shown in the upper plot, the surface treating pressure 72 increases until it reaches a plateau pressure 78. When the primary or pulse pump rate 76 is introduced, the surface treating pressure 72 follows by dropping in pressure and rapidly increasing to a second plateau pressure 80. The second plateau pressure 80 is at lower pressure than the plateau pressure 78. This change in pressure (delta P (ΔP)) shows the pressure drop in the surface treating pressure 72 is associated with opening of additional perforations and/or fractures in the formation. In the embodiment of FIG. 2, the method of this invention starts without proppant in the fracturing fluid. As the method of this embodiment proceeds, a proppant concentration 82 in the fracturing fluid is increased.

Figure 3:
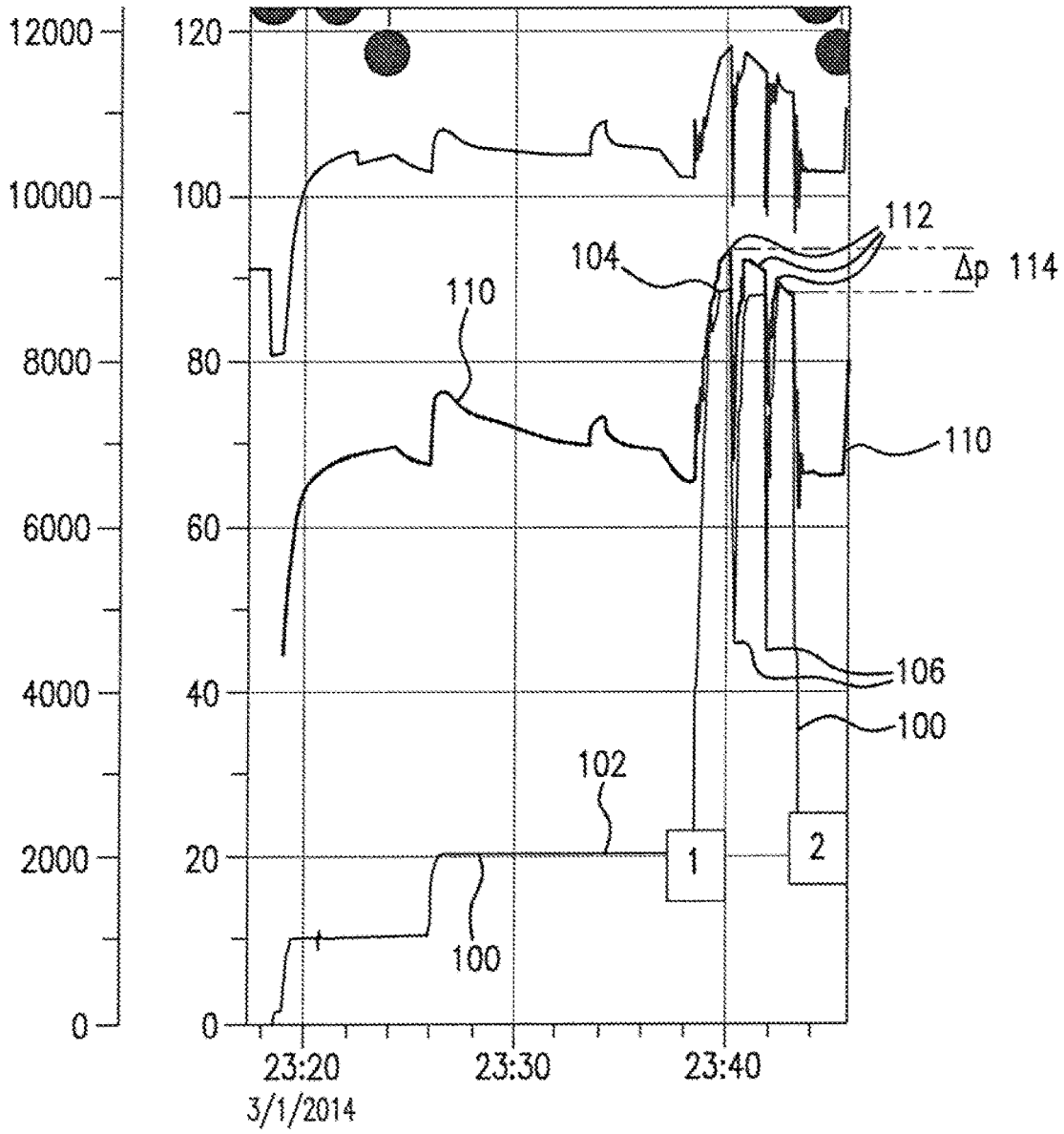
FIG. 3 is a graph showing a wellhead pump rate and a surface treating pressure of a method of hydraulic fracturing according to an embodiment of this invention.

In another embodiment as shown in FIG. 3, the method includes changing a fracturing pump rate 100 from 90 barrels per minute (bpm) to approximately 45 bpm, and then rapidly bringing the rate back to 90 bpm. Note that the rates mentioned here are meant as examples of sudden substantial rate decrease for creating a pressure pulse and are not intended to be limiting. The pumping of fracturing fluid or slurry into the wellhead causes a surface treating pressure 110 increase in the earth formation. In FIG. 3, the pump rate 100 is increased until it reaches an initial pump rate 102, approximately 20 bpm. Beginning at point 1; the pump rate 100 is increased to a pre-pulse or intermediate pump rate 104, approximately 90 bpm, and rapidly dropped to a primary or pulse pump rate 106, approximately 45 bpm, and returned to the pre-pulse or intermediate pump rate 104, approximately 90 bpm. In this embodiment, the pulse is repeated three times before returning to the initial pump rate 102 at point 2. The pump rate 100 causes a treating pressure 110 in the wellbore. This embodiment was implemented to induce three pressure impulses 112, however any number of pressure impulses may be used. In each successive pulse, when the pump rate 106 was brought back up to the pre-pulse or intermediate pump rate 104, the treating pressure 110, the pressure impulse 112, was lower, indicating that there was less friction in the system. This could only happen if additional flow channels have been opened, thus implying that previously unopened perforations have been opened or new fractures extending from perforations have been created. Delta P (ΔP) 114 shows the pressure drop in the treating pressure 110 of each the pressure impulses 112 associated with opening of additional perforations and/or fractures in this embodiment. The significance of this is that the method of this invention opens new perforations without physical flow diverters such as ball sealers or frac balls and doesn't cost anything extra to execute. However, strain is placed on the fracturing pumps while performing this kind of rapid pump rate change.

Figure 4:
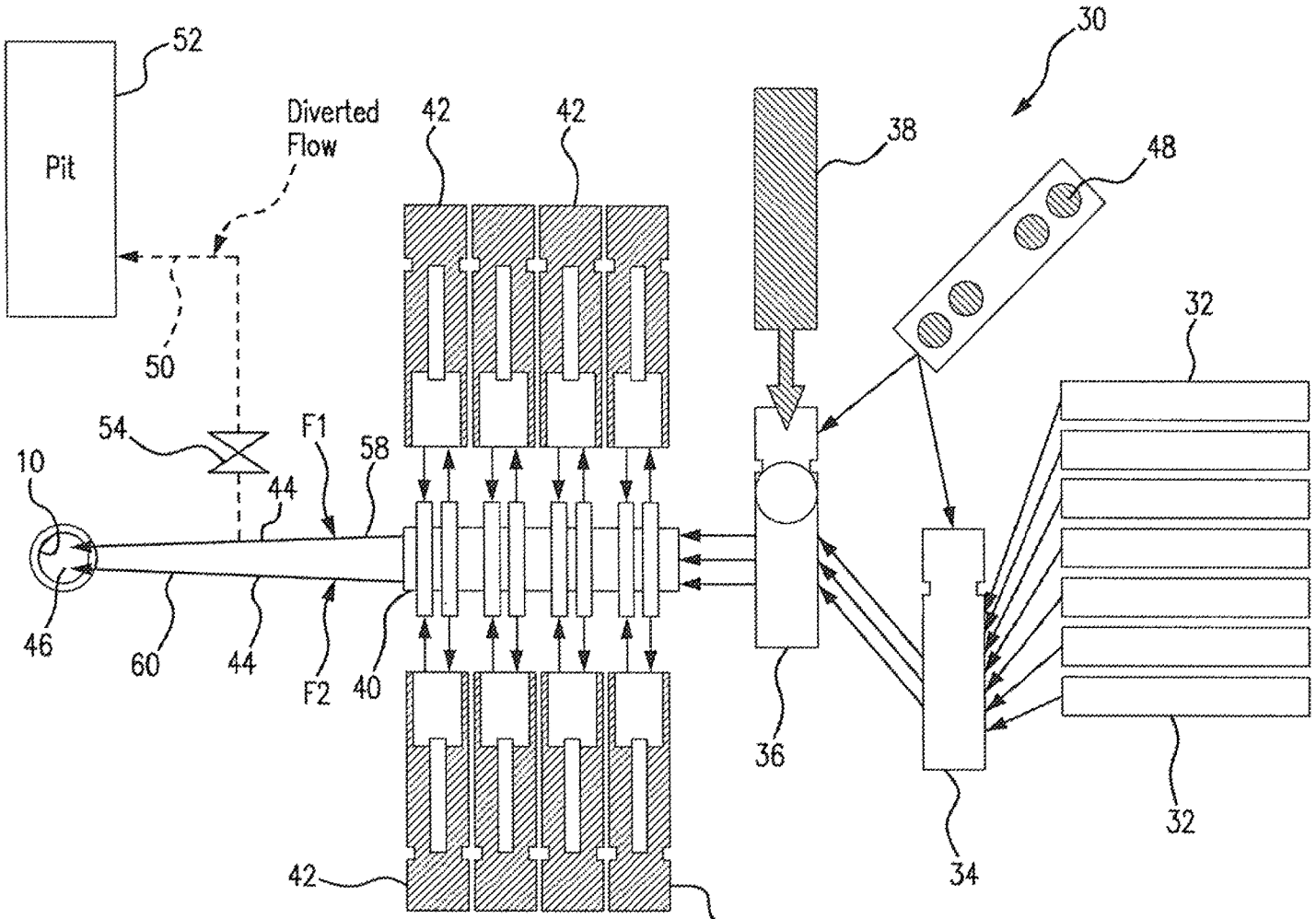
FIG. 4 is a schematic diagram of a system for hydraulic fracturing according to an embodiment of this invention.

In a preferred embodiment of this invention, rather than rapidly increasing and/or decreasing the pump rate of the fracturing pumps or in addition to changing the pump rate, a portion of the fracturing fluid, with or without proppant, is diverted away from the wellhead, changing the flow rate, in order to provide a pressure pulse to the wellbore 10. FIG. 4 shows a schematic representation of an embodiment of an overall system layout 30 of this invention for providing a pressure pulse to the wellbore 10 with or without changing the pump rate. The system 30 of this embodiment preferably includes a fracturing tank 32, generally a water tank, to store the water and/or other fluid that will comprise a portion of the fracturing fluid. The system 30 preferably also includes a pre-blender 34, preferably a mixing truck that mixes the water or other fluid from the fracturing tank with other components of the fracturing fluid such as polymers and other chemicals to make the fracturing fluid. At this point, the fracturing fluid preferably does not include a proppant. The system of this invention further includes a slurry-blender 36 that mixes the fracturing fluid with the proppant and/or other chemicals to create a fracturing slurry. The proppant is stored in a proppant storage and delivery system 38 prior to mixing in the slurry-blender 36. The system of this invention preferably further includes a manifold 40 that receives a fracturing slurry from the slurry-blender at a low pressure and distributes to a high-pressure fracturing pump 42. The high-pressure fracturing pump 42 returns the fracturing fluid, with or without the proppant, to the manifold 40 at a high-pressure and to a flow line 44 to a wellhead 46 connected to the wellbore 10. In a preferred embodiment, the system 30 further includes a chemical truck 48 which supplies chemicals to at least one of the pre-blender 34 and the slurry-blender 36.

Figure 5:
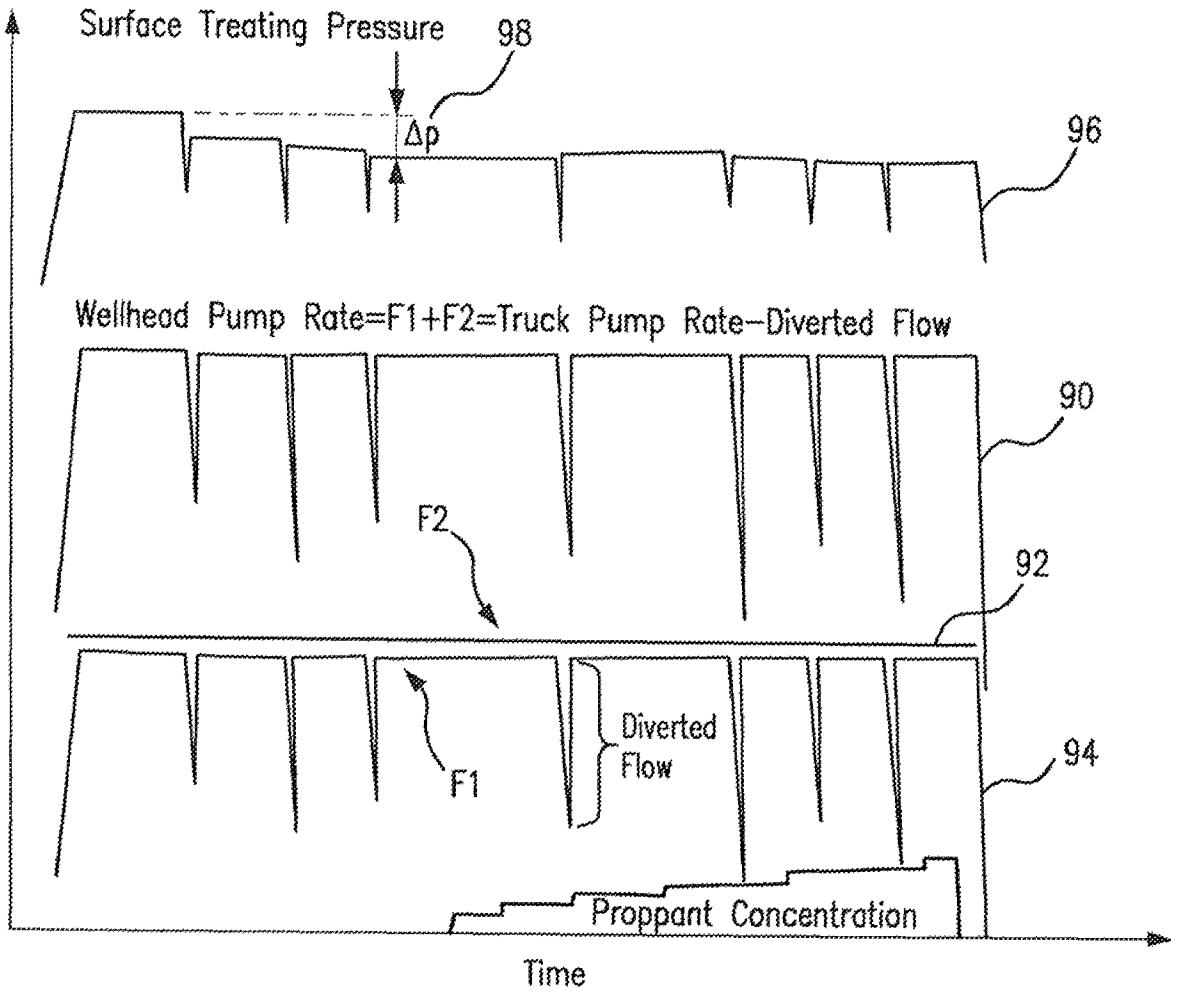
FIG. 5 is a graph showing a surface treating pressure and a wellhead pump rate where a portion of a total pump flow is diverted according to another embodiment of this invention.

In a preferred embodiment, the system of this invention includes a plurality of flow lines 44 to the wellhead 46. Preferably, at least one of the flow lines 44 is a variable-flow flow line 58 that is connected to a bleed-off line 50 connected to a pit 52 or some other type of storage, open or enclosed, or to another wellhead. While at least another one of the flow lines 44 is a constant rate flow line 60. In operation, the high-pressure fracturing pump 42 supplies the fracturing fluid or the initial fracturing fluid to the flow lines 44 at a constant pressure and the constant-flow line 60 supplies a first percentage of the flow rate supplied by the high-pressure fracturing pump to the wellbore and the variable-flow line 58 supplies a second percentage of the flow rate supplied by the high-pressure fracturing pump. In a preferred embodiment, the flow rate supplied by the constant-flow line 60 does not change during the pressure pulse, while the flow rate supplied by the variable-flow line 58 changes during the pressure pulse. A bleed-off valve 54 in the bleed-off line 50 connected to the variable-flow line 58 can be opened and closed to divert a portion of the fluid from the wellhead 46 to provide the pressure pulse to the wellhead 46. For example in FIG. 5, two flow lines are used to supply a wellhead pump rate 90, for example a total flow rate of 90 barrels per minute (bpm), to the wellhead 46. In this embodiment, the constant-flow line 60 and the variable-flow line 58 each supply a percentage of the total flow (F1+F2) for example the constant flow line supplies a constant flow rate 92 of 50% of the total flow, equaling 45 bpm, and the variable flow line supplies a variable flow rate 94 of 50% of the total flow, equaling 45 bpm. A pressure pulse is induced by allowing the constant-flow line F2 to continue supplying the 45 bpm and redirecting the flow F1 of the variable-flow line 58 away from the wellhead 46 for a short period of time into the pit 52. For example, the short period of time may range from 1 minute to 1 second. Preferably, the short period of time equals 10 seconds. Alternatively, any period of time may be used. By redirecting the flow for the short amount of time, the method simulates the case where some of the pumps are being shut down (one half of the pumps in the example case), inducing a pressure impulse in a surface treating pressure 96. As shown in FIG. 5, when the bleed-off valve was closed and the wellhead pump rate was returned to the truck pump rate, the surface treating pressure 96 is lower than the initial treating pressure, Delta P (ΔP) 98, indicating that there was less friction in the system. This could only happen if additional flow channels have been opened, thus implying that previously unopened perforations have been opened or new fractures extending from perforations have been created. The significance of this is that the method of this invention opens new perforations without physical flow diverters such as ball sealers or frac balls and does not require the truck pump rate to change. Please note the flow rates and times in the above example are exemplary and may be varied depending on the requirements of the wellbore and the earth formation.

In the embodiment of FIG. 5, the method of this invention starts without proppant in the fracturing fluid. As the method of this embodiment proceeds, a proppant concentration 82 in the fracturing fluid, is increased. Alternatively, the entire process may be conducted with or without the proppant.

In an alternative embodiment, one or more of the flow lines 44 may include a valve, not shown, that can be opened and closed to restrict a flow of fluid to the wellbore 10 to provide the pressure pulse.

Figure 6:
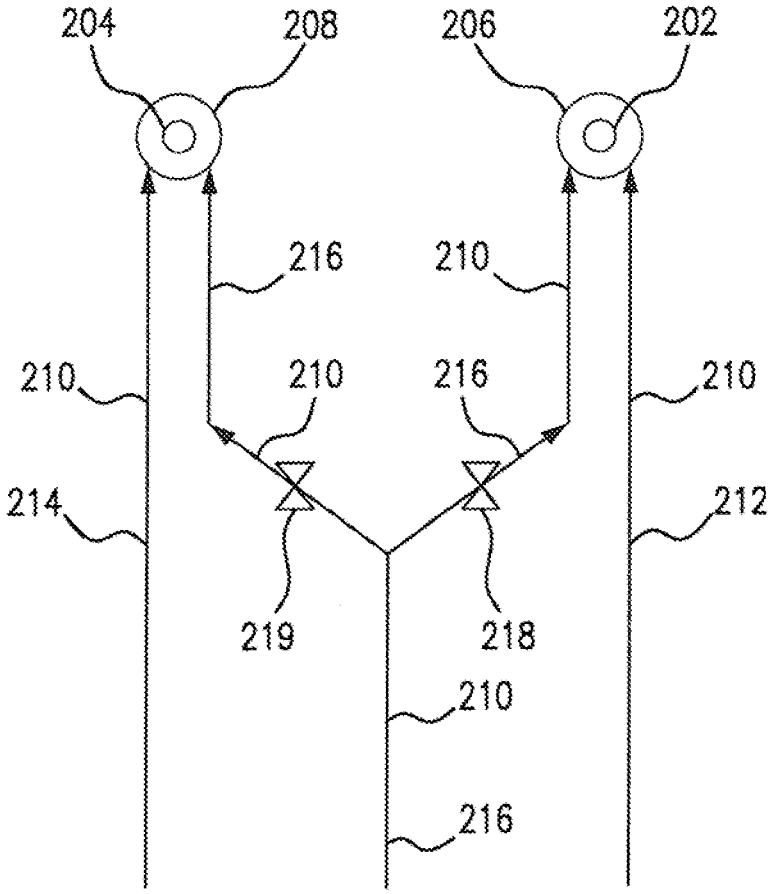
FIG. 6 is a schematic diagram of a portion of a system for hydraulic fracturing according to an alternative embodiment of this invention.
Figure 7:
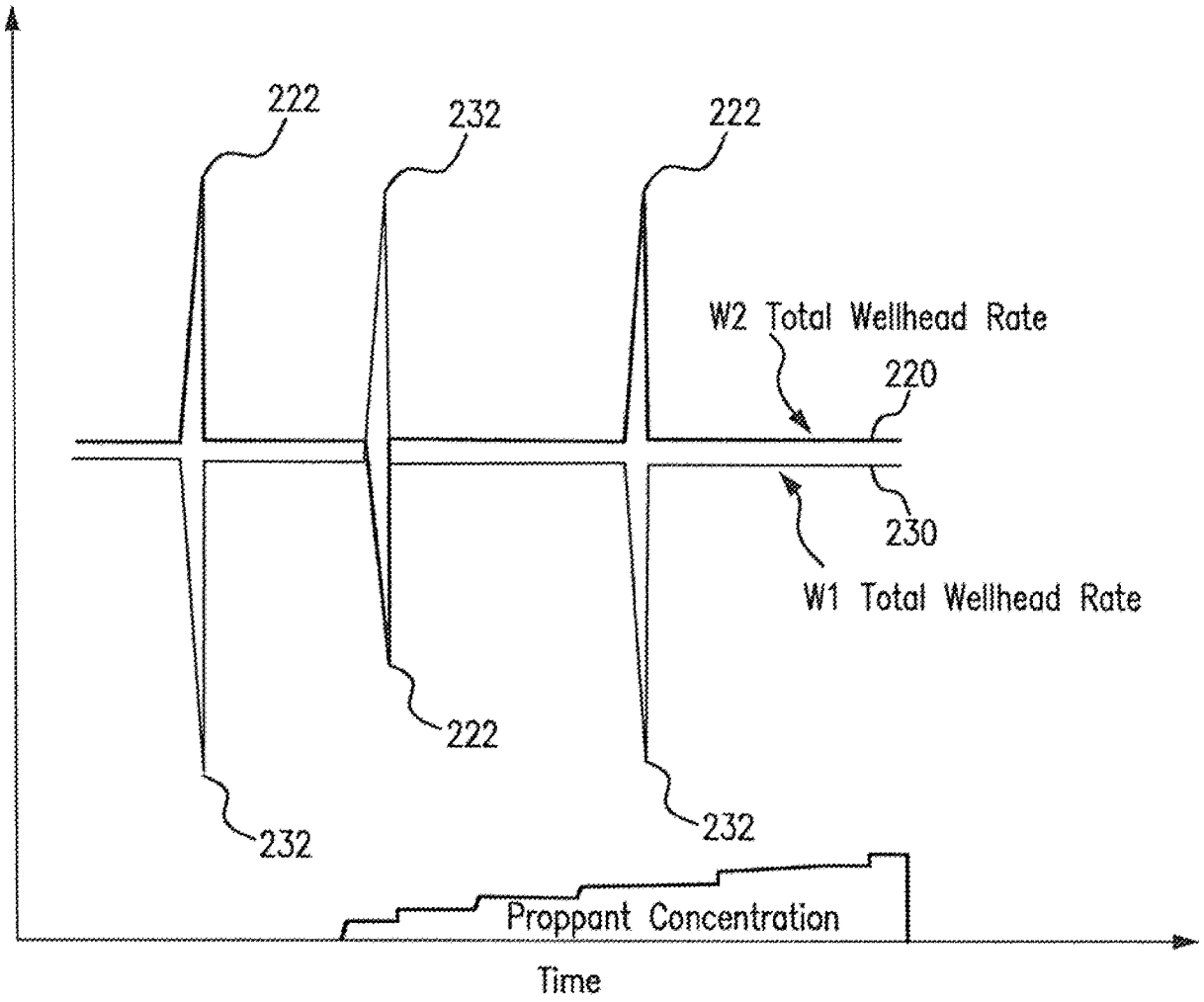
FIG. 7 is a graph showing a first total flow rate to a first wellhead and a second total flow rate to a second wellhead in another embodiment of this invention.

In another embodiment of this invention, partially shown in FIG. 6, the system includes a pair of wellheads 202, 204 each connected to a wellbore 206, 208. A plurality of flow lines 210 connect to the wellheads 202, 204. In this embodiment, each of the wellheads include a constant rate flow line 212, 214 and a diverter line 216 which is connected to both of the wellheads 202, 204. Each of the lines 212, 214, and 216 preferably connects to a system, not shown, for providing a pressure flow rate to the wellheads 202, 204, such as the system shown in FIG. 4. In the embodiment of FIG. 6, each of the wellheads 202, 204 includes a separate constant flow rate line 212, 214 and the wellheads 202, 204 share the diverter line 216 with one or more valves 218, 219. In operation, the high-pressure fracturing pump, not shown, supplies the fracturing fluid or the fracturing slurry to the flow lines 210 at a constant flow rate. A first percentage of the flow rate passes through the first constant rate flow line 212, a second percentage of the flow rate passes through the second constant flow rate line 2014, and a third percentage of the flow rate passes the diverter line 216. In a preferred embodiment, the flow rate supplied by each of the constant rate flow lines 212, 214 does not change during the pressure pulse. While the flow rate supplied by the diverter line 216 is diverted to each of the wellheads 202, 204 during the pressure pulse. For example in FIG. 7, the high-pressure fracturing pump provides a first total flow rate 220 to the first wellhead 202 and a second total flow rate 230 to the second wellhead 204. Initially, both valves 218 are open allowing the third percentage of the flow rate to be provided to both of the wellheads 202, 204. A pressure pulse 222, 232 is induced by closing one of the valves 219, increasing the total flow rate 220 to the first wellhead 202 and decreasing the total flow rate 230 to the second wellhead 204 for a short period of time. For example, the short period of time may range from 1 minute to 1 second. Preferably, the short period of time equals 10 seconds. Alternatively, any period of time may be used. The process is then repeated by closing the valve 218, increasing the total flow rate 230 to the second wellhead 204 and decreasing the total flow rate 220 to the first wellhead 202 for a short period of time. With this system, the fracturing fluid is conserved and not diverted to a pit.

In operation, one or more methods of this invention impart a flow rate change in the fracturing fluid flow that is preferably at least 10% below an original wellhead treatment rate, all the way to 0 (zero) rate. In a preferred embodiment, the flow rate change ranges from 25% to 75% lower and more preferably changes by 50%. Furthermore, the pressure impulse has a duration ranging from 1 minute to 1 second. Alternatively, the pressure impulses can be induced by increasing the flow rate change.

Multiple rate reductions can be executed during any part of the fracturing process. In a preferred embodiment, the method of this invention the rate reduction, pressure pulse, is least risky and potentially most effective in a pad stage, i.e. a stage of providing the fracturing fluid without the proppant. Performing these rapid, large flow rate variations and/or pump rate variations, especially reductions, in the pad stage presents the least amount of risk because there is no proppant in the equipment, the wellbore and the formation that can settle out or bridge during rate reductions as rate reductions decrease the fluid velocity and in turn decrease the fluids' proppant transport capabilities. The rate variations are also potentially more effective in the pad stage as they open new perforations and then the proppant-less fluid is able to extend the newly created fracture before proppant has a chance to bridge off and potentially close it.

Thus, the invention provides an improved hydraulic fracturing process that provides increased hydrocarbon production without the shortcomings of known processes.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A method of hydraulic fracturing stimulation comprising:

pumping a fracturing fluid with a fracturing pump;

injecting the fracturing fluid under pressure into a wellhead at an initial flow rate to at least one of: open perforations, create a fracture and open natural fractures;

changing the initial flow rate of the fracturing pump to a primary flow rate lower than the initial flow rate to introduce a change of flow rate into the wellhead for a period of time; and changing the primary flow rate to a secondary flow rate to at least one of: initiate additional fractures, extend existing fractures, open additional perforations and further extend natural fractures.

2. The method of claim 1, wherein the changing the initial flow rate comprises diverting a portion of the fracturing fluid away from the wellhead to provide a reduced flow rate to the wellhead for a pulse period of time.

3. The method of claim 2, wherein the primary flow rate is at least 25% lower than the initial flow rate.

4. The method of claim 2, wherein a system for conducting the method comprises a plurality of flow lines from a fracturing pump to the wellhead and wherein at least one of the plurality of flow lines includes a valve to redirect the portion of the fracturing fluid away from the wellhead to at least one of a pit and a second wellhead.

5. The method of claim 2, wherein the steps of changing the initial flow rate and changing the primary flow rate are repeated.

6. The method of claim 1, wherein the changing the initial flow rate comprises changing the initial flow rate to an intermediate flow rate prior to the primary flow rate.

7. The method of claim 1, wherein the secondary flow rate is equal to the initial flow rate.

8. The method of claim 1, wherein the secondary flow rate is less than initial flow rate.

9. The method of claim 1, wherein the secondary flow rate is greater than the initial flow rate.

10. The method of claim 1, wherein the steps of changing the initial flow rate and changing the primary flow rate are repeated.

11. The method of claim 1, wherein the steps of changing the initial flow rate and changing the primary flow rate are repeated a plurality of times.

12. A system for hydraulic fracturing stimulation comprising:

a high-pressure fracturing pump to pump a fracturing fluid;

a plurality of flow lines connecting the high-pressure fracturing pump and a wellhead extending into an earth formation to be fractured; and a means of rapidly increasing or decreasing an initial flow rate of the fracturing pump to generate a change of flow rate, wherein the change of flow rate comprises changing the initial flow rate to the wellhead to a primary flow rate and then to a secondary flow rate;

wherein the plurality of flow lines comprises at least one constant-flow flow line and at least one variable-flow flow line which includes a valve, wherein the at least one constant-flow line supplies a first percentage of a flow rate supplied by the high-pressure fracturing pump to the wellhead and the at least one variable-flow line supplies a second percentage of the flow rate supplied by the high-pressure fracturing pump that can be diverted, via the valve, to other than the wellhead.

13. The system of claim 12, wherein the flow rate supplied by the at least one constant-flow line does not change during the change of flow rate and the flow rate supplied by the at least one variable-flow line changes during the change of flow rate.

14. The system of claim 12, wherein the valve diverts the portion of the fracturing fluid from the wellhead to a second wellhead.

* * * * *